US009811025B2

(12) United States Patent
Abe et al.

(10) Patent No.: US 9,811,025 B2
(45) Date of Patent: Nov. 7, 2017

(54) DEVELOPER CONTAINER, DEVELOPMENT DEVICE, PROCESS CARTRIDGE, AND IMAGE FORMING APPARATUS

(71) Applicant: CANON KABUSHIKI KAISHA, Tokyo (JP)

(72) Inventors: Tsukasa Abe, Yokohama (JP); Tatsuro Harada, Mishima (JP); Akihiro Fujiwara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/052,518

(22) Filed: Feb. 24, 2016

(65) Prior Publication Data

US 2016/0252848 A1 Sep. 1, 2016

(30) Foreign Application Priority Data

Feb. 27, 2015 (JP) ..... 2015-039427

(51) Int. Cl.
*G03G 15/08* (2006.01)

(52) U.S. Cl.
CPC ..... *G03G 15/0891* (2013.01); *G03G 15/0889* (2013.01); *G03G 2215/085* (2013.01)

(58) Field of Classification Search
CPC ..... G03G 15/0822; G03G 15/0887; G03G 15/0889; G03G 15/0891; G03G 15/086; G03G 2215/0802; G03G 2215/085
USPC ..... 399/254
See application file for complete search history.

(56) References Cited

U.S. PATENT DOCUMENTS

| | | | | |
|---|---|---|---|---|
| 7,224,925 | B2 * | 5/2007 | Sato | G03G 15/0877 399/254 |
| 7,860,437 | B2 * | 12/2010 | Kakuta | G03G 15/0875 399/254 |
| 2009/0297178 | A1 * | 12/2009 | Kakuta | G03G 15/0889 399/27 |
| 2011/0123205 | A1 * | 5/2011 | Satomura | G03G 15/0856 399/27 |
| 2013/0011163 | A1 * | 1/2013 | Senda | G03G 15/0877 399/254 |
| 2013/0259530 | A1 * | 10/2013 | Kato | G03G 15/0889 399/254 |
| 2014/0056621 | A1 * | 2/2014 | Hashimoto | G03G 15/0889 399/254 |

(Continued)

FOREIGN PATENT DOCUMENTS

| | | | |
|---|---|---|---|
| JP | 2010-009021 | A | 1/2010 |
| JP | 2011-253203 | A | 12/2011 |

*Primary Examiner* — Sophia S Chen
(74) *Attorney, Agent, or Firm* — Canon USA, Inc. I.P. Division

(57) ABSTRACT

A developer container includes a conveyance member having at least a first sheet member and a second sheet member and configured to convey the developer, a deformation portion provided to contact the first sheet member and configured to elastically deform the first sheet member, and a release portion configured to release elastic deformation of the first sheet member to cause the developer on the first sheet member to fly toward an opening, wherein a containing chamber includes a recessed portion as viewed in a lengthwise direction of the containing chamber and wherein the second sheet member is in contact with a wall inside the recessed portion when the developer on the first sheet member is positioned at the release portion.

39 Claims, 7 Drawing Sheets

(56) References Cited

U.S. PATENT DOCUMENTS

| | | | | |
|---|---|---|---|---|
| 2014/0086599 | A1 | 3/2014 | Gofuku | |
| 2015/0212451 | A1* | 7/2015 | Shirakata | G03G 15/0887 399/254 |

* cited by examiner

DEVELOPER CONTAINER, DEVELOPMENT DEVICE, PROCESS CARTRIDGE, AND IMAGE FORMING APPARATUS

BACKGROUND OF THE INVENTION

Field of the Invention

The present invention relates to a developer container, a development device, a process cartridge, and an image forming apparatus. In particular, the present invention is preferably applied to a color electro-photographic image forming apparatus.

The electro-photographic image forming apparatus is an image forming apparatus that forms an image on a recording material using an electro-photographic image forming method. Examples of the electro-photographic image forming apparatus include an electro-photographic copying machine, an electro-photographic printer (e.g., laser beam printer, light-emitting diode (LED) printer), a facsimile apparatus, and a word processor.

The process cartridge is a unit having at least an image bearing member. Generally, the process cartridge is a cartridge into which a charging unit, a development unit, or a cleaning unit and the image bearing member are integrated, which is attachable to and detachable from a main body of the image forming apparatus.

Further, the development device is a unit including at least a developer bearing member. Generally, the development device is a unit into which a development unit, a development frame member for supporting the development unit, and relative components are integrated, which is attachable to and detachable from the apparatus main body of the image forming apparatus.

In addition, the developer container is a container for storing developer.

Description of the Related Art

In the image forming apparatus such as a printer employing an electro-photographic image forming method (i.e., electro-photographic process), an electro-photographic photosensitive member (hereinafter, referred to as "photosensitive member") serving as an image bearing member is electrically charged uniformly. Then, the charged photosensitive member is exposed selectively, so that an electrostatic image is formed on the photosensitive member. Subsequently, the electrostatic image formed on the photosensitive member is visualized as a toner image with toner serving as developer. Then, the toner image formed on the photosensitive member is transferred onto a recording material such as a recording sheet or a plastic sheet, and then heat and pressure are further applied to the toner image transferred onto the recording material, so that the toner image is fixed onto the recording material and the image is recorded thereon.

Generally, maintenance work for various processing units is necessary for the above-described image forming apparatus. In order to easily execute the maintenance work of various processing units, a photosensitive member, a charging unit, a development unit, and a cleaning unit are collectively mounted within a frame member and practically used as a process cartridge that is attachable to and detachable from an image forming apparatus (i.e., apparatus main body). By employing the process cartridge method, it is possible to provide an image forming apparatus excellent in usability.

Such a configuration has been known that the above-described process cartridge includes a cleaning unit having a photosensitive member, a development unit having a development means, and a toner unit for supplying developer.

With respect to a configuration for attaching and detaching the process cartridge (or these units) to and from the apparatus main body, there is provided a method in which the process cartridge is attached to and detached from the apparatus main body in an axis line direction of a photosensitive drum. The process cartridge attached to the apparatus main body is moved upward in a vertical direction, and a position of the process cartridge is fixed when a regulated portion disposed on the process cartridge contacts a regulation portion disposed on the apparatus main body.

In the above-described cartridge method, in order to allow a user to replace a cartridge at proper timing, a function for displaying a number of remaining printable sheets may be added thereto. In order to add such a function, an amount of developer remaining within the cartridge has to be detected or estimated, so that various methods have been provided therefor.

From among the various methods, a light-transmission remaining developer amount detection method has been widely used. In this method, a light path passing through a developer containing chamber is created by a light emitting element such as an LED and a light receiving element such as a phototransistor, and an amount of remaining developer is detected based on a time period during which the light path is blocked by the developer.

In the light-transmission remaining developer amount detection method, as a means for guiding the detection light into the developer containing chamber, a light-emission side light guiding member and a light-reception side light guiding member may be disposed on the developer containing chamber.

The light-emission side light guiding member guides detection light emitted from the light emitting element such as the LED to the inside of the developer containing chamber. The light-reception side light guiding member guides the detection light that has passed through the inside of the developer containing chamber to the light receiving element such as the phototransistor disposed outside the developer containing chamber.

Further, Japanese Patent Application Laid-Open No. 2010-009021 discusses a method in which a light guiding member integrally configured of the light-emission side light guiding member and the light-reception side light guiding member is arranged in a central region in a lengthwise direction of the developer containing chamber.

Further, the development unit may include a developer bearing member for supplying developer to the photosensitive member, a development chamber provided with a developer supply member for supplying the developer to the developer bearing member, and a developer containing chamber for storing the developer to be supplied to the development chamber. In addition, there may be a case where the developer has to be supplied against a gravitational force because the developer containing chamber is positioned below the development chamber in a gravitational direction.

As a method for conveying the developer from the developer containing chamber to the development chamber disposed above the developer containing chamber, there is provided a method in which a flexible sheet member is attached to an agitation member for agitating the developer within the developer containing chamber with the rotational movement of the agitation member. Further, there is provided a development unit having a deformation position and a restoration position. At the deformation position, a sheet member is elastically deformed by making the sheet member abut on a side wall of the developer containing chamber, and at the restoration position, the elastic deformation of the sheet member is released when the developer from the developer containing chamber to the development chamber is conveyed. Thus, the developer is conveyed by a force generated when the sheet member shifts from a deformation state to a restoration state (Japanese Patent Application Laid-Open No. 2011-253203).

However, according to the configuration described in Japanese Patent Application Laid-Open No. 2011-253203, considering the configurations of other components, a recessed portion extending in a lengthwise direction of the developer containing chamber may be provided on a part of the developer containing chamber. When the sheet member moves from the recessed portion to the deformation position, there is a risk that the developer borne on the sheet member may fall off because of misalignment of the contact position between the sheet member and the side wall. As a result, an amount of developer supplied to the development chamber is decreased, and thus there may be an unfavorable effect on image quality.

SUMMARY OF THE INVENTION

According to an aspect of the present invention, a developer container includes a containing chamber having an opening and configured to store developer, a conveyance member having at least a first sheet member and a second sheet member, disposed on the containing chamber, and configured to convey the developer, a deformation portion provided to contact the first sheet member and configured to elastically deform the first sheet member, and a release portion configured to release elastic deformation of the first sheet member to cause the developer on the first sheet member to fly toward the opening, wherein the containing chamber includes a recessed portion as viewed in a lengthwise direction of the containing chamber, wherein a length of the recessed portion is longer than a length of the first sheet member in the lengthwise direction of the containing chamber, and wherein the second sheet member is in contact with a wall inside the recessed portion when the developer on the first sheet member is positioned at the release portion.

Further, the present invention is directed to a development device, a process cartridge, and an image forming apparatus.

Further features of the present invention will become apparent from the following description of exemplary embodiments with reference to the attached drawings.

DESCRIPTION OF THE EMBODIMENTS

Exemplary embodiments of the present invention will be described below in detail with reference to the appended drawings. However, dimensions, materials, and shapes of the constituent components and relative arrangements thereof described in the exemplary embodiments should be changed as appropriate according to the configurations and various conditions of the apparatus to which the present invention is applied. In other words, the scope of the present invention is not to be limited to the exemplary embodiments described below.

<Electro-Photographic Image Forming Apparatus>

Figure 2:
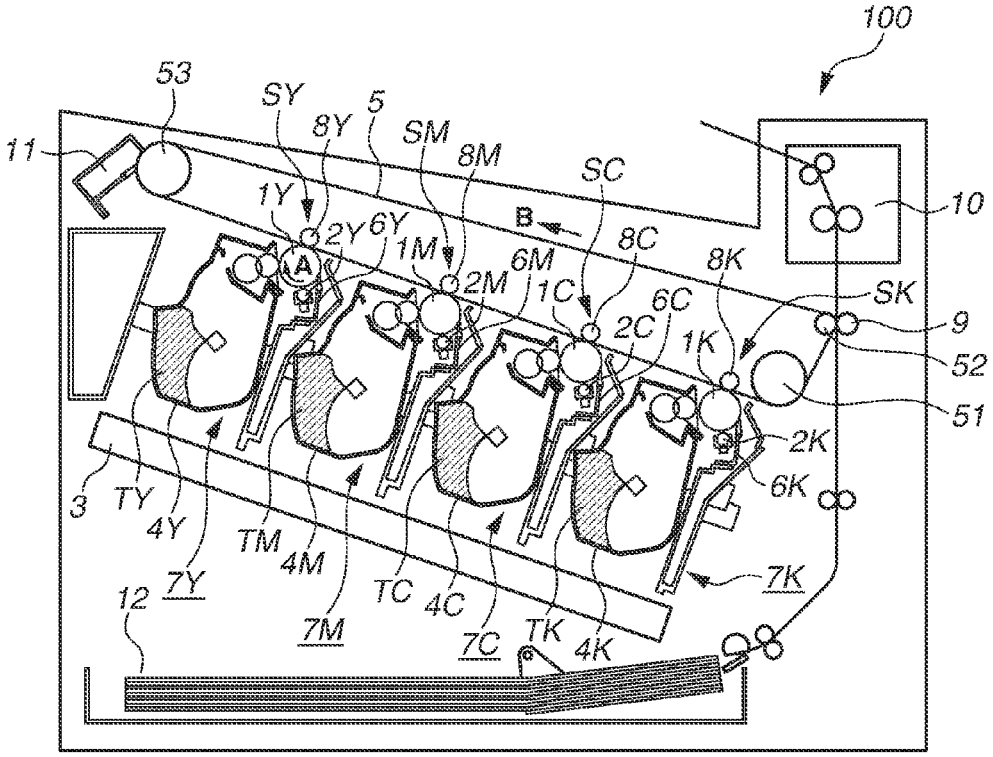
FIG. 2 is a schematic cross-section diagram illustrating an electro-photographic image forming apparatus according to the first exemplary embodiment.

First, an overall configuration of an image forming apparatus according to an exemplary embodiment of the present invention will be described with reference to FIG. 2. FIG. 2 is a cross-section diagram illustrating an image forming apparatus 100 according to the present exemplary embodiment.

The image forming apparatus 100 includes a first, a second, a third, and a fourth image forming units SY, SM, SC, and SK for forming images in respective colors of yellow (Y), magenta (M), cyan (C), and black (K) as a plurality of image forming units.

In the present exemplary embodiment, configurations and operations of the first to the fourth image forming units SY, SM, SC, and SK are substantially the same except for colors of the images formed thereby. Accordingly, if it is not necessary to distinguish between the first to the fourth image forming units SY, SM, SC, and SK, description thereof will be collectively given while omitting the symbols Y, M, C, and K. However, the exemplary embodiment is not limited thereto, and the image forming apparatus 100 may include image forming units having different configurations or operations. For example, the image forming unit for the black (K) color may have a larger capacity for a longer operation period in comparison to the rest of the image forming units.

In the present exemplary embodiment, the image forming apparatus 100 includes four photosensitive members (i.e., four photosensitive drums) 1 (1Y, 1M, 1C, and 1K) serving as image bearing members. Each of the photosensitive members 1 rotates in a direction indicated by an arrow A. A charging roller 2 (2Y, 2M, 2C, 2K) and a scanner unit (exposure device) 3 are disposed around each photosensitive member 1.

The charging roller 2 is a charging member serving as a charging unit that uniformly charges a surface of the photosensitive member 1. The scanner unit 3 is an exposure unit that forms an electrostatic image (electrostatic latent image) on the photosensitive member 1 by emitting a laser beam based on image information. Further, a development device (hereinafter, referred to as "development unit") 4 (4Y, 4M, 4C, and 4K) and a cleaning blade 6 (6Y, 6M, 6C, and 6K) serving as a cleaning unit are disposed around the photosensitive member 1.

Further, an intermediate transfer belt 5 serving as an intermediate transfer member for transferring toner images formed on the four photosensitive members 1 onto a recording material 12 is disposed to face the photosensitive members 1.

Further, in the present exemplary embodiment, the development unit 4 uses toner T (TY, TM, TC, and TK) as developer, which is nonmagnetic mono-component developer. In the present exemplary embodiment, the development unit 4 executes contact development by causing a development roller 17 serving as a developer bearing member to contact the photosensitive member 1. However, the developer is not limited to the nonmagnetic mono-component developer, and magnetic developer or two-component developer may be used according to the configuration.

In the present exemplary embodiment, the photosensitive member 1, the charging roller 2, the cleaning blade 6, and a waste toner containing portion 14*a* for storing transfer residual toner (waste toner) on the photosensitive member 1 constitute a photosensitive unit 13.

Further, in the present exemplary embodiment, the development unit 4 and the photosensitive unit 13 are integrated into a cartridge to constitute a process cartridge 7 (7Y, 7M, 7C, 7K). The process cartridge 7 is attachable to and detachable from the apparatus main body of the image forming apparatus 100 via an attachment means such as an attachment guide and a positioning member (not illustrated) disposed on the image forming apparatus 100.

In the present exemplary embodiment, "apparatus main body" refers to a configuration portion of the image forming apparatus 100 excluding at least the process cartridge 7 from the configuration of the image forming apparatus 100. Further, the development unit 4 may be configured to be attachable to and detachable from the apparatus main body independently. In such a case, "apparatus main body" refers to a configuration portion of the image forming apparatus 100 excluding the development unit 4 from the configuration thereof.

In the present exemplary embodiment, all of the process cartridges 7 of respective colors have a same shape. In addition, the toner T in respective colors of yellow (TY), magenta (TM), cyan (TC), and black (TK) are stored within the process cartridges 7 of respective colors.

The intermediate transfer belt 5 abuts on all of the photosensitive members 1 and rotates in a direction indicated by an arrow B in FIG. 2. The intermediate transfer belt 5 is stretched around a plurality of supporting members such as a driving roller 51, a secondary transfer counter roller 52, and a driven roller 53.

On the inner circumferential surface side of the intermediate transfer belt 5, four primary transfer rollers (8Y, 8M, 8C, and 8K) serving as primary transfer units are arranged side by side to face the respective photosensitive members 1. Further, a secondary transfer roller 9 serving as a secondary transfer unit is disposed on the outer circumferential surface side of the intermediate transfer belt 5, at a position facing the secondary transfer counter roller 52.

<Image Forming Processing>

When image formation is executed, at first, a surface of the photosensitive member 1 is uniformly charged by the charging roller 2. Next, the charged surface of the photosensitive member 1 is subjected to a scanning-exposure with laser light emitted from the scanner unit 3 according to image information, so that an electrostatic latent image according to the image information is formed on the photosensitive member 1. Then, the electrostatic latent image formed on the photosensitive member 1 is developed as a toner image by the development unit 4. The toner image formed on the photosensitive member 1 is primarily transferred onto the intermediate transfer belt 5 through an operation of the primary transfer roller 8.

For example, when a full-color image is formed, the above-described process is sequentially executed by the first to the fourth image forming units SY, SM, SC, and SK, so that the toner images in respective colors are sequentially superimposed and primarily transferred onto the intermediate transfer belt 5. Thereafter, a recording material 12 is conveyed to a secondary transfer portion in synchronization with the movement of the intermediate transfer belt 5. Then, through the operation of the secondary transfer roller 9 abutting on the intermediate transfer belt 5 via the recording material 12, a four-color toner image formed on the intermediate transfer belt 5 is secondarily transferred collectively onto the recording material 12.

The recording material 12 on which the toner image is transferred is conveyed to a fixing device 10 serving as a fixing unit. The fixing device 10 applies heat and pressure onto the recording material 12, so that the toner image is fixed to the recording material 12.

The primary transfer residual toner remaining on the photosensitive member 1 after the primary transfer process is removed by the cleaning blade 6. Further, the secondary transfer residual toner remaining on the intermediate transfer belt 5 after the secondary transfer process is removed by an intermediate transfer belt cleaning device 11.

Although the image forming apparatus 100 according to the present exemplary embodiment includes four image forming units, the image forming processing can be executed by only one of these image forming units. Further, a multi-color image can be formed by using only two or three image forming units.

Further, a number of image forming units is not limited to four, and may be increased to five to ten as necessary. In this case, the image forming apparatus 100 may include image forming units of the same color. Further, the image forming apparatus 100 may include only one image forming unit.

<Process Cartridge>

Next, an overall configuration of the process cartridge 7 attached to the apparatus main body of the image forming apparatus 100 according to the present exemplary embodiment will be described with reference to FIGS. 3 and 4.

Figure 3:
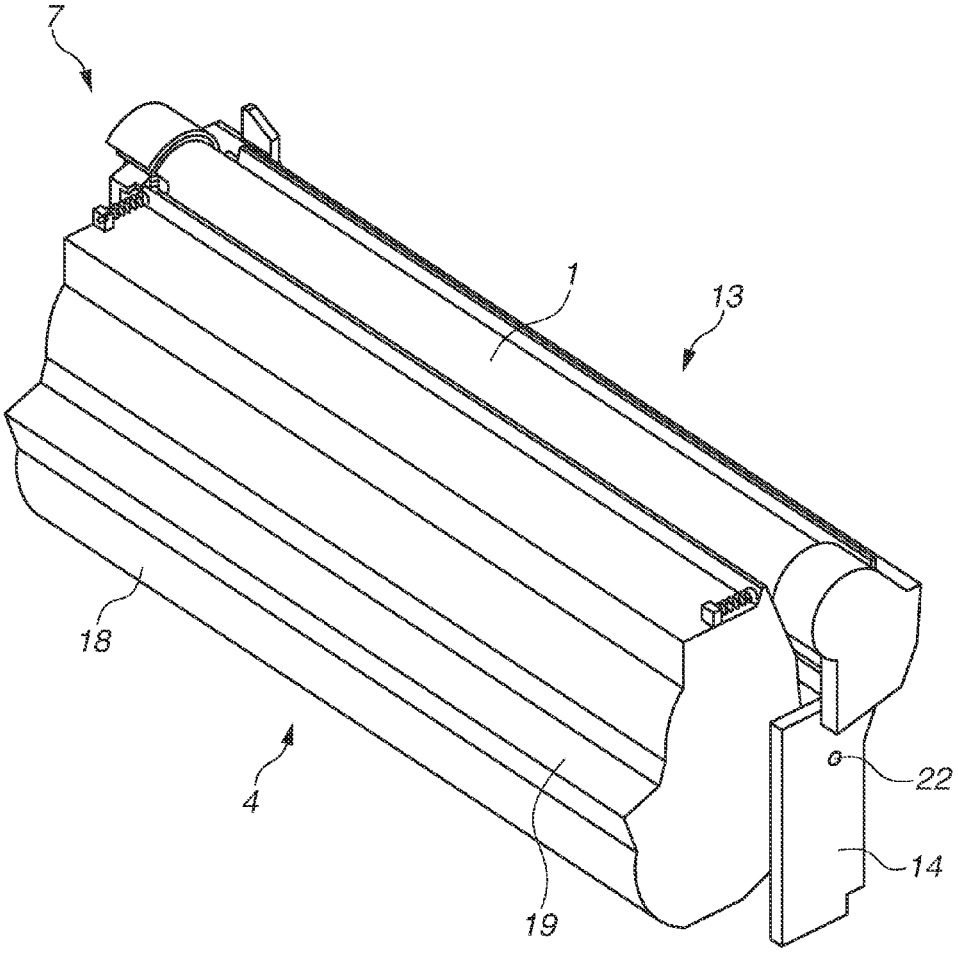
FIG. 3 is a schematic perspective diagram illustrating the process cartridge according to the first exemplary embodiment.

FIG. 3 is a schematic perspective diagram illustrating the process cartridge 7.

Figure 4:
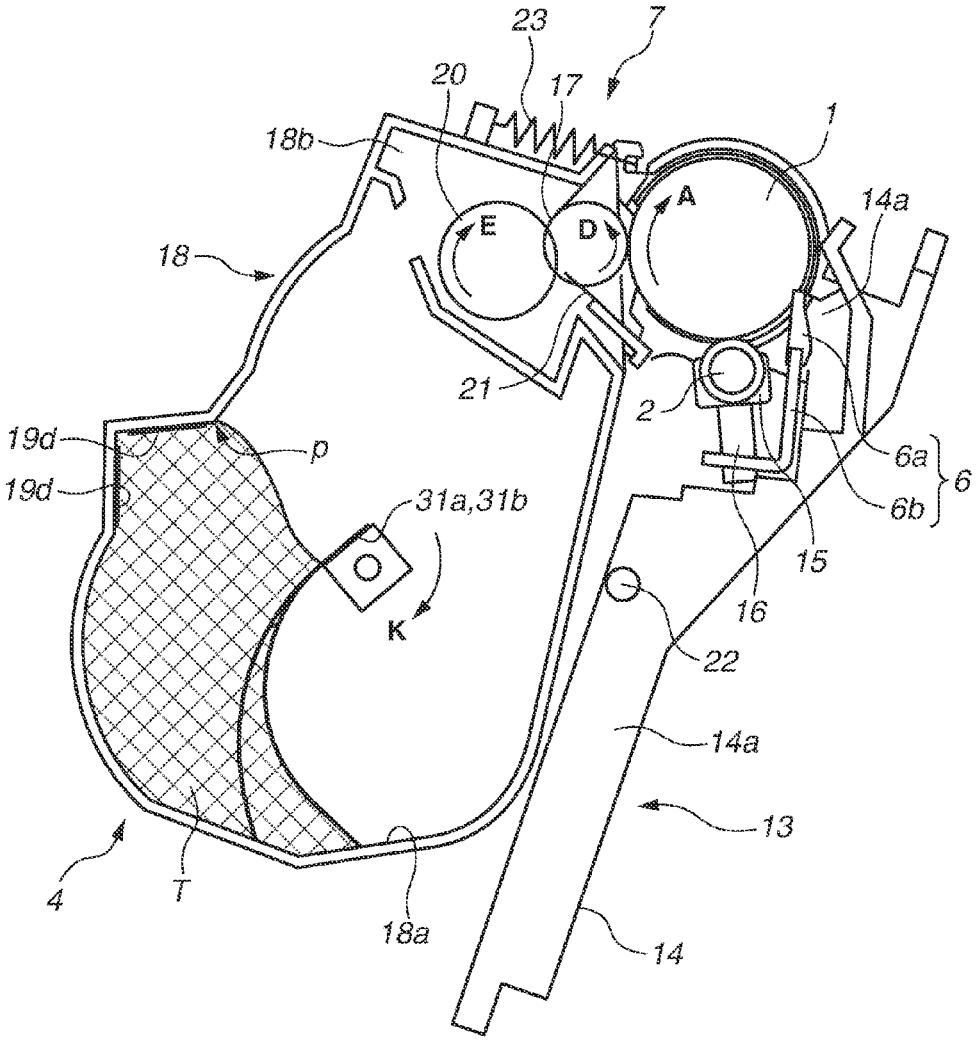
FIG. 4 is a schematic cross-section diagram illustrating the process cartridge according to the first exemplary embodiment.

FIG. 4 is a schematic cross-section diagram illustrating the process cartridge 7.

The photosensitive unit 13 includes a cleaning frame member 14 serving as a frame member for supporting various components within the photosensitive unit 13. The photosensitive member 1 is attached to the cleaning frame member 14 via a shaft bearing member, to be rotatable in a direction indicated by an arrow A in FIG. 4.

Further, a charging roller shaft bearing 15 is attached to the cleaning frame member 14 along a line passing through the rotation centers of the charging roller 2 and the photosensitive member 1. The charging roller shaft bearing 15 is movably attached thereto. The charging roller 2 is rotatably attached to the charging roller shaft bearing 15. Then, the charging roller shaft bearing 15 is urged toward the photosensitive member 1 by a charging roller pressure spring 16 serving as an urging means.

Further, the cleaning blade 6 is integrally formed of an elastic member 6*a* for removing the transfer residual toner (waste toner) remaining on a surface of the photosensitive member 1 after the primary transfer process and a supporting member 6*b* for supporting the elastic member 6*a*.

The waste toner removed from the surface of the photosensitive member 1 by the cleaning blade 6 falls in a gravitational direction through a space formed by the cleaning blade 6 and the cleaning frame member 14, so as to be stored in the waste toner containing portion 14*a*.

The development unit 4 includes a development frame member 18 for supporting various components within the development unit 4. The development roller 17 serving as a developer bearing member, which contacts the photosensitive member 1 to rotate in a direction indicated by an arrow D (i.e., counter-clockwise direction) in FIG. 4, is provided in the development unit 4. The development roller 17 is rotatably supported by the development frame member 18 via shaft bearings at both end portions in a lengthwise direction thereof (i.e., rotation axis line direction).

Further, the development unit 4 includes a developer containing chamber (hereinafter, referred to as "toner containing chamber") 18*a* and a development chamber 18*b* in which the development roller 17 is arranged.

A toner supply roller 20 serving as a developer supply member contacting the development roller 17 to rotate in a direction indicated by an arrow E, and a development blade 21 serving as a developer regulation member for regulating a toner layer on the development roller 17 are arranged in the development chamber 18*b*.

Further, a toner conveyance member 30 (see e.g., FIG. 1 and FIG. 6) for agitating the stored toner T while conveying the toner T to the toner supply roller 20 is disposed in the toner containing chamber 18*a* of the development frame member 18.

Further, the development unit 4 is coupled to the photosensitive unit 13, so as to be freely rotatable about a fitting shaft 22 that is fixed and supported by the cleaning frame member 14. Further, the development unit 4 is urged by a pressure spring (extension spring) 23. Therefore, when the process cartridge 7 performs an image forming operation, the development unit 4 rotates about the fitting shaft 22, and the photosensitive member 1 and the development roller 17 abut on each other.

<Toner Conveyance Configuration>

In the present specification, terms such as "upper", "lower", "vertical", and "horizontal" that express directions of the configurations and the operations of the development unit (development device) and the process cartridge are used to express directions thereof when the development unit or the process cartridge is viewed in the normal use state unless otherwise specified in particular. In other words, in the normal use state of the development unit (development device) or the process cartridge, the development unit or the process cartridge is properly attached to the apparatus main body of the properly-installed image forming apparatus, so as to be capable of executing the image forming operation.

Subsequently, a toner conveyance configuration within the development unit 4 of the process cartridge 7 according to a first exemplary embodiment of the present invention will be described in detail.

Figure 1:
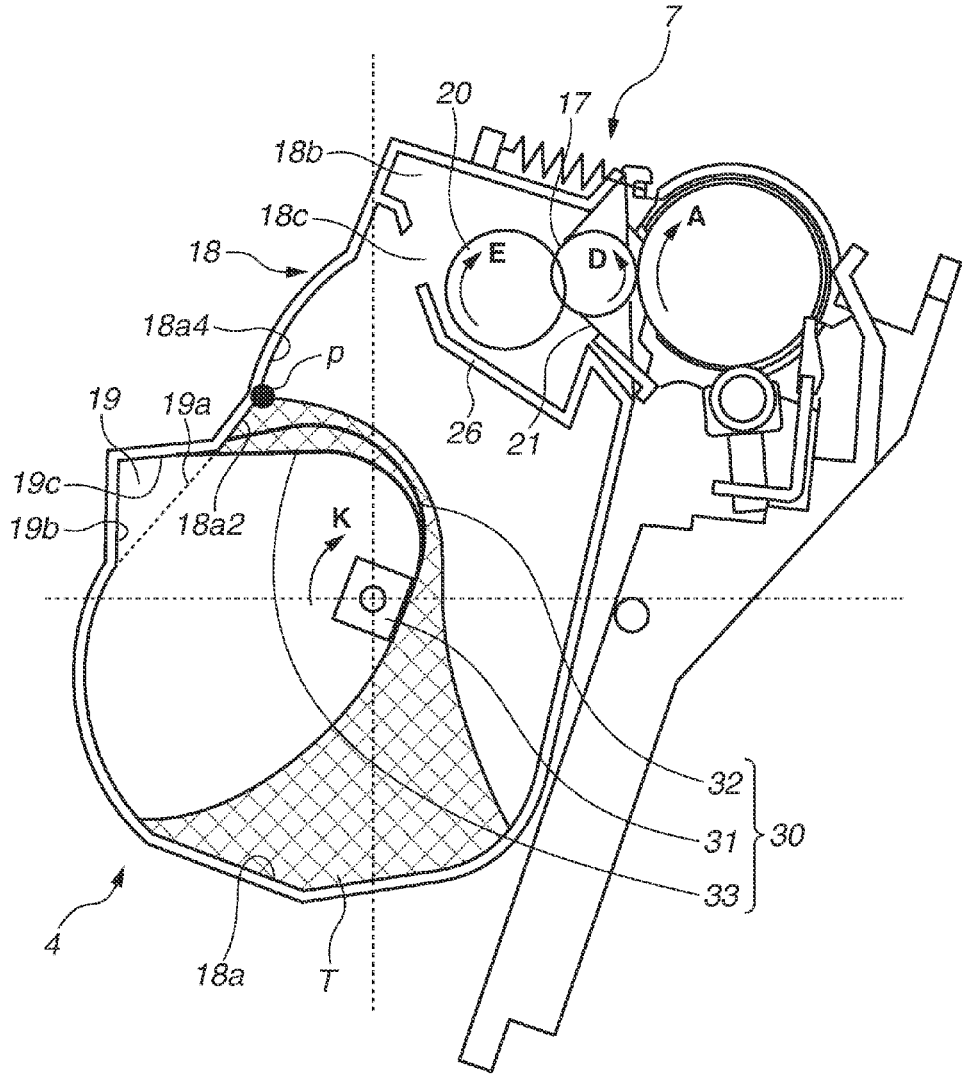
FIG. 1 is a diagram illustrating a toner conveyance configuration of a process cartridge according to a first exemplary embodiment of the present invention.

FIG. 1 is a schematic cross-sectional diagram of the process cartridge 7 illustrating a conveyance state of toner.

Figure 5:
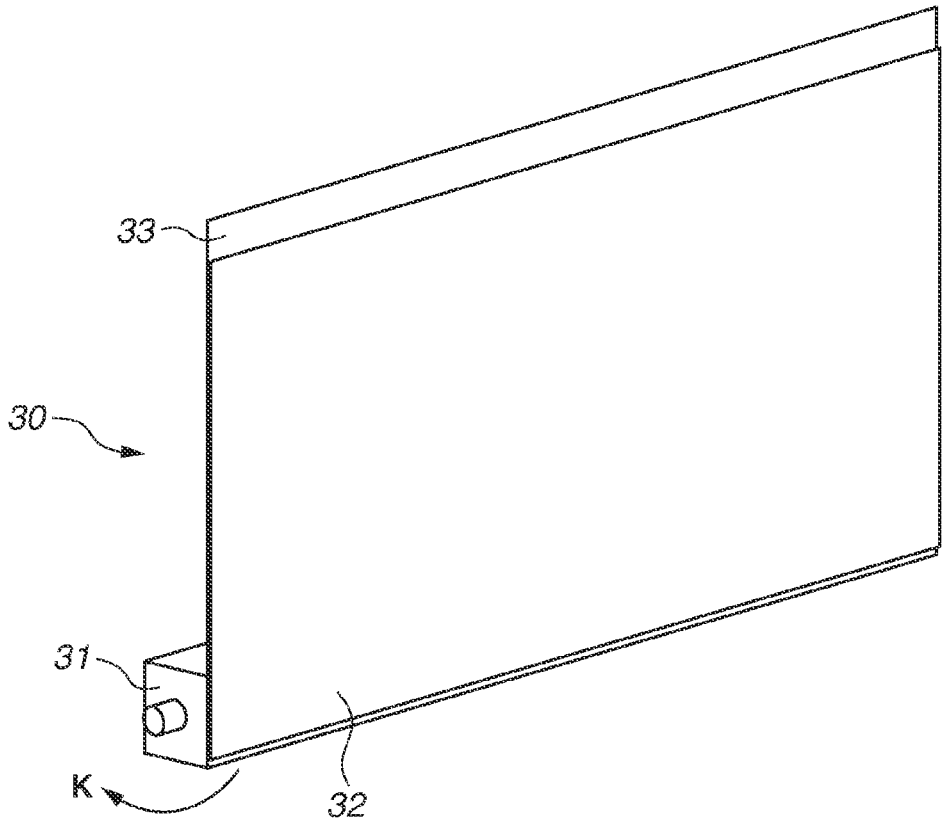
FIG. 5 is a schematic perspective diagram illustrating a toner conveyance member according to the first exemplary embodiment.

FIG. 5 is a schematic perspective diagram of the toner conveyance member 30 illustrating a toner conveyance configuration.

The development unit 4 includes the development chamber 18*b* and the toner containing chamber 18*a*. The development roller 17, the supply roller 20, and the development blade 21 are disposed in the development chamber 18*b*. Toner that is to be supplied to the development chamber 18*b* is stored in the toner containing chamber 18*a*, and the toner conveyance member 30 for supplying the toner to the development chamber 18*b* is disposed in the toner containing chamber 18*a*. Then, the toner containing chamber 18*a* is disposed below the development chamber 18*b* in a vertical direction. Accordingly, the toner has to be conveyed against the gravitational force, from the toner containing chamber 18*a* to the development chamber 18*b*.

A partition wall 26 having an opening 18*c* for allowing the toner to pass through is provided between the development chamber 18*b* and the toner containing chamber 18*a*. The opening 18*c* is provided above the toner containing chamber 18*a*. Further, the toner conveyance member 30 for supplying toner to the development chamber 18*b* disposed in the toner containing chamber 18*a*, is rotatably supported by the development frame member 18, which constitutes the toner containing chamber 18*a*, at both end portions in a lengthwise direction thereof (i.e., rotation axis line direction). The toner conveyance member 30 is rotationally driven in a direction indicated by an arrow K (i.e., clockwise direction) in FIG. 1 by a driving unit (driving source) which is not illustrated.

A guide portion 18*a*2 serving as a deformation portion abutting on the first sheet member 32 is disposed below the opening 18*c* of the toner container chamber 18*a*. The first sheet member 32 abuts on the guide portion 18*a*2 along with the rotation thereof. With this configuration, the first sheet member 32 receives force from the guide portion 18*a*2. As a result, the first sheet member 32 elastically deforms against the elastic force of the first sheet member 32. The first sheet member 32 rotates in a state of contacting the guide member 18*a*2, so that toner is borne on a surface thereof on the downstream side in the rotation direction. In the present exemplary embodiment, as illustrated in FIG. 1, the guide portion 18*a*2 is a portion of an inner wall of the toner containing chamber 18*a* up to a point "p" (i.e., release portion) where the first sheet member 32 is separated from the inner wall. Further, a restoration portion 18*a*4 is provided in the toner container chamber 18*a*, at a position on the downstream side of the guide portion 18*a*2 and the upstream side of the opening 18*c* in the rotation direction of the first sheet member 32. The restoration portion 18*a*4 includes a portion at which the contact between the first sheet member 32 and the inner wall of the toner containing chamber 18*a* is released and a portion at which the first sheet member 32 passes by to return to an original state from a deformation state. In the present exemplary embodiment, an end portion of the restoration portion 18*a*4 positioned on the upstream side in the rotation direction of the first sheet member 32 is the point "p" serving as a release portion at which the contact between the first sheet member 32 and the inner wall is released.

Accordingly, after a leading end of the first sheet member 32 on a free end side thereof (i.e., an inner wall side of the toner containing chamber 18*a*) passes by the guide portion 18*a*2 along with the rotation of the first sheet member 32, the abutment of the first sheet member 32 and the inner wall of the toner containing chamber 18*a* is released at the release portion. Then, the first sheet member 32 is released from a state of elastic deformation caused by the guide portion 18*a*2 and restored to a natural state (i.e., an original shape) by its own elastic restoration force.

In the present exemplary embodiment, a recessed portion 19 is provided on the inner wall of the toner containing chamber 18*a* (i.e., containing chamber) when the toner containing chamber 18*a* is viewed in a lengthwise direction thereof. As illustrated in FIG. 3, the recessed portion 19 extends in the lengthwise direction of the toner containing chamber 18*a*. A length of the recessed portion in the lengthwise direction is longer than a length (width) of the first sheet member 32 in the axis line direction thereof. Therefore, the leading end of the first sheet member 32 enters the inner portion of the recessed portion 19. With the above-described recessed portion 19, a storage space of the toner can be secured when the developer capacity is to be increased.

In the present exemplary embodiment, as illustrated in FIG. 1, the recessed portion 19 is a portion or a region defined by inner walls 19*b* and 19*c* of the toner containing chamber 18*a* and a dotted line 19*a* when the toner containing chamber 18*a* is viewed in the lengthwise direction thereof or in the axis line direction of the development roller 17.

The recessed portion 19, the deformation portion, and the release portion are provided on one side in a case where the toner containing chamber 18*a* is viewed in the lengthwise direction thereof while a straight line in a gravitational direction passing through the rotation center of the toner conveyance member 30 is set to be a boundary line. The development roller 17, the supply roller 20, and the photosensitive member 1 are disposed on the opposite side thereof.

In the present exemplary embodiment, the recessed portion 19 is positioned on the upstream side of the deformation portion, the release portion, and the restoration portion in the rotation direction of the first sheet member 32. Further, the recessed portion 19 may preferably be positioned adjacent to the deformation portion. In particular, when the first sheet member 32 is rotating while the leading end portion thereof is in contact with the recessed portion 19, a belly portion of the first sheet member 32 contacts the deformation portion on the way of the rotation. Therefore, an abutment position of the first sheet member 32 and a side wall of the toner containing chamber 18*a* is changed. Because of the above change, the toner borne on the first sheet member 32 cannot be held as it is, so that a part of the toner on the first sheet member 32 falls off. A second sheet member 33 is provided in order to reduce the amount of the falling off toner. By providing the second sheet member 33, the toner can be held between the first sheet member 32 and the second sheet member 33, and thus it is possible to restrain the toner on the first sheet member 32 from falling off further.

Further, when the toner on the first sheet member 32 is positioned at the release portion where the toner on the first sheet member 32 is likely to fall off, the second sheet member 33 is in contact with the inner wall of the recessed portion 19. With this configuration, the toner borne on the second sheet member 33 is held by the second sheet member 33 without falling off, so that the toner falling off from the first sheet member 32 is reduced.

Further, a remaining amount detection unit 19*d* that detects the amount of remaining toner (i.e., amount of developer) may be arranged on the toner containing chamber 18*a* (see FIG. 4). In the present exemplary embodiment, the remaining amount detection unit 19*d* is arranged in a region of the recessed portion 19 of the toner containing chamber 18*a*. In FIG. 4, a pair of electrodes made of conductive resin is disposed on the inner surface (wall surface) that constitutes the recessed portion 19. The electrodes may be disposed on a surface of the wall, or may be embedded inside the wall. Further, the electrodes may be disposed on the outside of the wall.

In the present exemplary embodiment, the remaining amount detection unit 19*d* is positioned on the upstream side of the restoration portion 18*a*4 in the rotation direction of the toner conveyance member 30. In this case, in a state where the elastic deformation of the first sheet member 32 is released after the first sheet member 32 has passed by the guide portion 18*a*2, the toner borne on the first sheet member 32 may fall into a region within the recessed portion 19 where the remaining amount detection unit 19*d* is disposed.

Therefore, as illustrated in FIGS. 1, 4, and 5, the second sheet member 33 is fixed to the same plane as a plane 31*a* of an agitation shaft (rotation member) 31 to which the first sheet member 32 is fixed. In addition, the second sheet member 33 is fixed to a position on the upstream side of the first sheet member 32 in the rotation direction of the toner conveyance member 30. In other words, the second sheet member 33 is fixed and held between the first sheet member 32 and the rotation member 31.

Further, the second sheet member 33 according to the present exemplary embodiment is formed in such a manner that the leading end thereof is longer than that of the first sheet member 32. In other words, in the present exemplary embodiment, a length from an attachment position to a leading end of the sheet member is longer in the second sheet member 33. In the configuration described below, the above relationship between the lengths of the first and the second sheet members 32 and 33 are reversed.

For example, the first sheet member 32 and the second sheet member 33 can be preferably formed by using a flexible resin sheet such as a polyester film, a polyphenylene sulfide film, or a polycarbonate film. The thicknesses of the first sheet member 32 and the second sheet member 33 may preferably be 50 μm to 250 μm.

Because of the toner conveyance member 30 configured as described above, as illustrated in FIG. 1, when the elastic deformation of the first sheet member 32 is released after the first sheet member 32 has passed by the guide portion 18*a*2, the leading end of the second sheet member 33 contacts the wall of the recessed portion 19. Then, because of the toner borne on the second sheet member 33, the toner borne on and conveyed by the first sheet member 32 is prevented from falling into the recessed portion 19, and flies toward the opening 18*c* against the gravitational force.

Next, a toner conveyance configuration within the development unit 4 of the process cartridge 7 according to a second exemplary embodiment will be described in detail.

Figure 6:
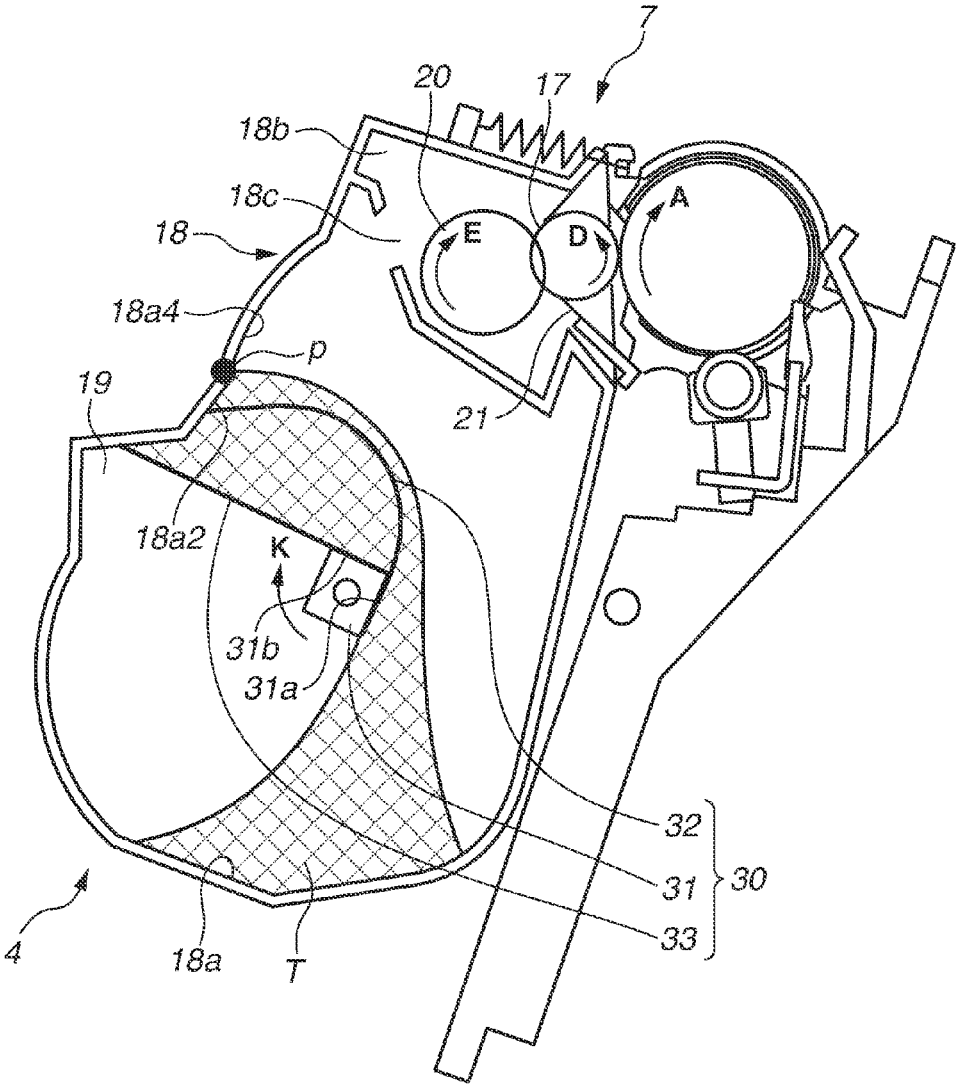
FIG. 6 is a diagram illustrating a toner conveyance configuration of a process cartridge according to a second exemplary embodiment of the present invention.

FIG. 6 is a schematic cross-sectional diagram of the process cartridge 7 illustrating a conveyance state of toner.

Figure 7:
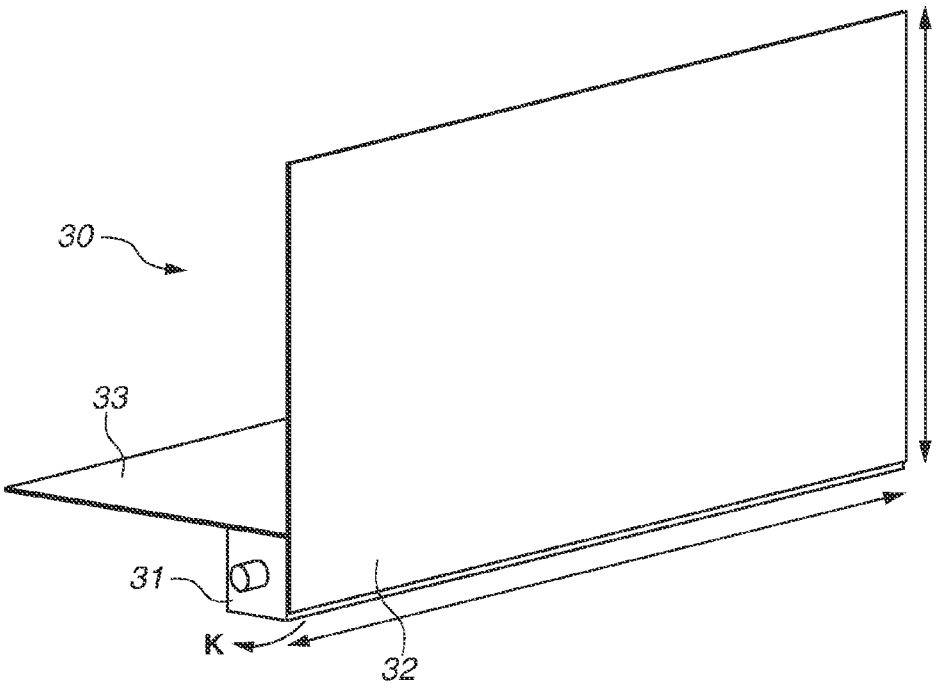
FIG. 7 is a schematic perspective diagram illustrating a toner conveyance member according to the second exemplary embodiment

FIG. 7 is a schematic perspective diagram of the toner conveyance member 30 illustrating a toner conveyance configuration.

In the present exemplary embodiment, as illustrated in FIG. 7, the toner conveyance member 30 for conveying toner to the development chamber 18*b* is provided to be rotatable. The toner conveyance member 30 is rotatably supported by the development frame member 18 that constitutes the toner containing chamber 18*a* at both end portions in a lengthwise direction thereof (i.e., rotation axis line direction). The toner conveyance member 30 is rotationally driven in a direction indicated by an arrow K in FIG. 6 (i.e., clockwise direction) by a driving unit (driving source) which is not illustrated. The first sheet member 32 is fixed to one plane 31*a* of the rotation member 31 of the toner conveyance member 30. Further, the second sheet member 33 is fixed to a plane 31*b* on the upstream side in the rotation direction, which is adjacent to the plane 31*a* of the toner conveyance member 30 to which the first sheet member 32 is fixed. At this time, a distance between the attachment position and the leading end of the sheet member is shorter in the second sheet member 33 than in the first sheet member 32.

For example, the first sheet member 32 and the second sheet member 33 can be preferably formed by using a flexible resin sheet such as a polyester film, a polyphenylene sulfide film, or a polycarbonate film. The thicknesses of the first sheet member 32 and the second sheet member 33 may preferably be 50 μm to 250 μm.

Because of the toner conveyance member 30 configured as described above, as illustrated in FIG. 6, when the elastic deformation of the first sheet member 32 is released at the release portion after the first sheet member 32 has passed by the guide portion 18*a*2, the leading end of the second sheet member 33 contacts the wall of the recessed portion 19. Then, because of the toner borne on the second sheet member 33, the toner borne on and conveyed by the first sheet member 32 is prevented from falling into the recessed portion 19, and flies toward the opening 18*c* against the gravitational force.

As another exemplary embodiment, the second sheet member may be provided at a position on an upstream side of the first sheet member in the rotation direction of the toner conveyance member, further than that in the second exemplary embodiment, and a length of the second sheet member may be shorter than that in the second exemplary embodiment. Further, the second sheet member may be provided at a position on a downstream side of the first sheet member in the rotation direction of the toner conveyance member, further than that in the second exemplary embodiment, and a length of the second sheet member may be longer than that in the second exemplary embodiment but shorter than that in the first exemplary embodiment.

Further, in the first and the second exemplary embodiments, configurations of the process cartridges attachable to and detachable from the apparatus main body have been described. However, the development device may be configured to be attachable to and detachable from the apparatus main body independently. In such a case, the photosensitive member may be fixed to the apparatus main body, or the photosensitive member itself may be configured as a photosensitive device to be attachable to and detachable from the apparatus main body. Further, the developer container itself may be configured to be attachable to and detachable from the apparatus main body.

Further, in the above-described exemplary embodiments, the toner conveyance member includes the first sheet member and the second sheet member. However, the configuration thereof is not limited thereto, and the toner conveyance member may include a third sheet member or other members. For example, the toner conveyance member may include an electrode member for detecting an amount of remaining toner or a cleaning member for cleaning a surface of the remaining toner amount detection portion.

As described above, even if a container chamber has a recessed portion extending in the lengthwise direction of the container chamber, the toner can be conveyed efficiently with a sheet configuration of the toner conveyance member.

According to the present invention, when the sheet member moves from the recessed portion to the deformation portion, an amount of developer on the sheet member is prevented from being reduced. As a result, the developer is conveyed efficiently, and therefore the image quality can be secured.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-039427, filed Feb. 27, 2015, which is hereby incorporated by reference herein in its entirety.

What is claimed is:

1. A developer container comprising:

a conveyance member, having at least a first sheet member and a second sheet member, configured to convey a developer;

a chamber configured to store developer, the chamber comprising:

a recessed portion recessed away from the conveyance member in a radial direction of the conveyance member, as viewed in a lengthwise direction of the chamber; and a deformation portion provided next to the recessed portion in a rotational direction of the conveyance member and configured to elastically deform the first sheet member, and wherein a length of the recessed portion is longer than a length of the first sheet member in the lengthwise direction of the chamber, and wherein the second sheet member is in contact with a wall inside the recessed portion when the first sheet member contacts the deformation portion.

2. The developer container according to claim 1, wherein the first sheet member is positioned on a downstream side of the second sheet member in a rotation direction of the conveyance member.

3. The developer container according to claim 1, wherein the first sheet member and the second sheet member are overlapped with each other and attached to a rotation member of the conveyance member.

4. The developer container according to claim 1, wherein the first sheet member and the second sheet member are attached to a same surface of a rotation member of the conveyance member.

5. The developer container according to claim 1, wherein a surface of a rotation member of the conveyance member to which the first sheet member is attached is different from a surface of the rotation member of the conveyance member to which the second sheet member is attached.

6. The developer container according to claim 1, wherein a length from an attachment position to a free end of the first sheet member is shorter than a length from an attachment position to a free end of the second sheet member.

7. The developer container according to claim 1, wherein a length from an attachment position to a free end of the first sheet member is longer than a length from an attachment position to a free end of the second sheet member.

8. The developer container according to claim 1 further comprising a detection unit configured to detect change in an amount of developer in the recessed portion.

9. A development device comprising:

a developer bearing member configured to bear developer; and the developer container according to claim 1.

10. The development device according to claim 9 further comprising:

a development chamber arranged above the chamber of the developer container in a gravitational direction, wherein in a case the chamber of the developer container is a containing chamber, the development chamber includes the developer bearing member, and developer is supplied from the containing chamber through an opening.

11. The development device according to claim 9, wherein the developer container includes a release portion configured to release elastic deformation of the first sheet member to convey the developer, and wherein an opening is arranged on an opposite side of the recessed portion with respect to a boundary line set to be, when the chamber is viewed in the lengthwise direction of the chamber, a straight line in a gravitational direction passing through a rotation center of the conveyance member.

12. A process cartridge comprising:

an image bearing member; and the developer container according to claim 1.

13. An image forming apparatus comprising the developer container according to claim 1, and configured to form an image on a recording material.

14. The developer container according to claim 1 further comprising a release portion configured to release elastic deformation of the first sheet member to convey the developer.

15. The developer container according to claim 14, wherein the deformation portion and the recessed portion are adjacent to each other when viewed in the lengthwise direction of the chamber.

16. The developer container according to claim 14, wherein the recessed portion is positioned above a rotation center of the conveyance member in a gravitational direction.

17. The developer container according to claim 14, wherein fallen developer is held between the first sheet member and the second sheet member when the first sheet member is positioned at the release portion while the second sheet member is in contact with the wall inside the recessed portion, and wherein the fallen developer is the developer having fallen from the first sheet member.

18. The developer container according to claim 14, wherein the recessed portion, the deformation portion, and the release portion are arranged on one side of a boundary line set to be, when the chamber is viewed in the lengthwise direction of the chamber, a straight line in a gravitational direction passing through a rotation center of the conveyance member.

19. The developer container according to claim 14 further comprising electrodes, on an inner surface of the recessed portion, configured to detect an amount of developer.

20. The developer container according to claim 1, wherein when the first sheet member starts contacting the deformation portion, some developer falls from a surface of the first sheet member to the second sheet member.

21. A developer container comprising:

a conveyance member, having at least a first sheet member and a second sheet member, configured to convey a developer;

a chamber configured to store developer, the chamber comprising:

a recessed portion recessed away from the conveyance member in a radial direction of the conveyance member, as viewed in a lengthwise direction of the chamber;

a deformation portion provided to contact the first sheet member and configured to elastically deform the first sheet member; and a release portion configured to release elastic deformation of the first sheet member to convey the developer, and wherein a length of the recessed portion is longer than a length of the first sheet member in the lengthwise direction of the chamber, and wherein the second sheet member is in contact with a wall inside the recessed portion when the first sheet member contacts the release portion.

22. The developer container according to claim 21, wherein when the first sheet member starts contacting the deformation portion, some developer falls from a surface of the first sheet member to the second sheet member.

23. The developer container according to claim 21, wherein the deformation portion and the recessed portion are adjacent to each other when viewed in the lengthwise direction of the chamber.

24. The developer container according to claim 21, wherein the recessed portion is positioned above a rotation center of the conveyance member in a gravitational direction.

25. The developer container according to claim 21, wherein fallen developer is held between the first sheet member and the second sheet member when the first sheet member is positioned at the release portion while the second sheet member is in contact with the wall inside the recessed portion, and wherein the fallen developer is the developer having fallen from the first sheet member.

26. The developer container according to claim 21, wherein the first sheet member is positioned on a downstream side of the second sheet member in a rotation direction of the conveyance member.

27. The developer container according to claim 21, wherein the recessed portion, the deformation portion, and the release portion are arranged on one side of a boundary line set to be, when the chamber is viewed in the lengthwise direction of the chamber, a straight line in a gravitational direction passing through a rotation center of the conveyance member.

28. The developer container according to claim 21, wherein the first sheet member and the second sheet member are overlapped with each other and attached to a rotation member of the conveyance member.

29. The developer container according to claim 21, wherein the first sheet member and the second sheet member are attached to a same surface of a rotation member of the conveyance member.

30. The developer container according to claim 21, wherein a surface of a rotation member of the conveyance member to which the first sheet member is attached is different from a surface of the rotation member of the conveyance member to which the second sheet member is attached.

31. The developer container according to claim 21, wherein a length from an attachment position to a free end of the first sheet member is shorter than a length from an attachment position to a free end of the second sheet member.

32. The developer container according to claim 21, wherein a length from an attachment position to a free end of the first sheet member is longer than a length from an attachment position to a free end of the second sheet member.

33. The developer container according to claim 21, further comprising a detection unit configured to detect change in an amount of developer in the recessed portion.

34. The developer container according to claim 21, further comprising electrodes, on an inner surface of the recessed portion, configured to detect an amount of developer.

35. A development device comprising:

a developer bearing member configured to bear developer; and the developer container according to claim 21.

36. The development device according to claim 35, further comprising:

a development chamber arranged above the chamber of the developer container in a gravitational direction, wherein in a case the chamber of the developer container is a containing chamber, the development chamber includes the developer bearing member, and developer is supplied from the containing chamber through an opening.

37. The development device according to claim 35, wherein the developer container includes a release portion configured to release elastic deformation of the first sheet member to convey the developer, and wherein an opening is arranged on an opposite side of the recessed portion with respect to a boundary line set to be, when the chamber is viewed in the lengthwise direction of the chamber, a straight line in a gravitational direction passing through a rotation center of the conveyance member.

38. A process cartridge comprising:

an image bearing member; and the developer container according to claim 21.

39. An image forming apparatus comprising the developer container according to claim 21 and configured to form an image on a recording material.

* * * * *